US008746353B2

(12) United States Patent
Forsberg et al.

(10) Patent No.: US 8,746,353 B2
(45) Date of Patent: Jun. 10, 2014

(54) VIBRATION METHOD TO DETECT ONSET OF GAS LOCK

(75) Inventors: Michael A. Forsberg, Claremore, OK (US); Ketankumar K. Sheth, Tulsa, OK (US); Brown Lyle Wilson, Tulsa, OK (US); Donn J. Brown, Broken Arrow, OK (US); Dehao David Zhu, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 354 days.

(21) Appl. No.: 13/270,555

(22) Filed: Oct. 11, 2011

(65) Prior Publication Data

US 2012/0027630 A1 Feb. 2, 2012

Related U.S. Application Data

(63) Continuation-in-part of application No. 12/486,121, filed on Jun. 17, 2009, now Pat. No. 8,141,646, which is a continuation-in-part of application No. 12/144,092, filed on Jun. 23, 2008, now Pat. No. 7,798,215.

(60) Provisional application No. 61/521,791, filed on Aug. 10, 2011, provisional application No. 60/946,190, filed on Jun. 26, 2007.

(51) Int. Cl.
*E21B 43/00* (2006.01)

(52) U.S. Cl.
USPC ..... 166/369; 166/105; 166/250.15

(58) Field of Classification Search
USPC ..... 166/369, 105, 250.15; 417/443, 444, 417/554
See application file for complete search history.

(56) References Cited

U.S. PATENT DOCUMENTS

| | | | | |
|---|---|---|---|---|
| 7,218,997 | B2 * | 5/2007 | Bassett | 700/286 |
| 7,624,800 | B2 | 12/2009 | Jamieson et al. | |
| 7,953,575 | B2 | 5/2011 | Schoonover | |
| 8,141,646 | B2 * | 3/2012 | Allen et al. | 166/369 |
| 2008/0067116 | A1 | 3/2008 | Anderson et al. | |
| 2009/0000789 | A1 | 1/2009 | Leuthen et al. | |
| 2009/0250210 | A1 | 10/2009 | Allen et al. | |
| 2010/0288501 | A1 | 11/2010 | Fielder et al. | |

OTHER PUBLICATIONS

Jeremy Jensen and Kenwood Dayton, "Detecting Cavitation in Centrifugal Pumps: Experimental Results of the Pump Laboratory," Orbit, Second Quarter 2000, 26-30.
Johann Friedrich Gulich, "Centrifugal Pumps" 559-621 (Springer 2008).
PCT International Preliminary Report on Patentability mailed Apr. 24, 2014.

* cited by examiner

*Primary Examiner* — William P Neuder
(74) *Attorney, Agent, or Firm* — Bracewell & Giuliani LLP

(57) ABSTRACT

Vibration of an electric submersible pump assembly is monitored to produce a vibration spectrum. The vibration spectrum is compared to a known vibration signature for a pump condition that precedes gas lock. The pump condition is at least one of an impeller rotating stall condition, a diffuser stall condition, a pre-surge condition, and percentage of free gas within the wellbore fluid. Operation of the pump is then adjusted in response to the similarity of the vibration spectrum to the vibration signature for the pump condition to prevent impending gas lock.

20 Claims, 7 Drawing Sheets

VIBRATION METHOD TO DETECT ONSET OF GAS LOCK

This application claims priority to and the benefit of co-pending U.S. Provisional Application No. 61/521,791, by Forsberg et al., filed on Aug. 10, 2011, entitled "Vibration Method to Detect Onset of Gas Lock," which application is incorporated herein by reference.

This application is a continuation in part of U.S. Utility patent application Ser. No. 12/486,121, entitled "Device and Method for Gas Lock Detection in an Electrical Submersible Pump Assembly" by Allen et al., filed on Jun. 17, 2009, published as U.S. Patent Application Publication No. 2009/0250210, on Oct. 8, 2009, currently pending before the United States Patent and Trademark Office, which is a continuation in part of U.S. Utility patent application Ser. No. 12/144,092, by Leuthen et al., titled "Device, Method and Program Product to Automatically Detect and Break Gas Locks in an ESP" filed on Jun. 23, 2008, which issued as U.S. Pat. No. 7,798,215 on Sep. 21, 2010, which claims priority to U.S. Provisional Patent Application No. 60/946,190, by Leuthen et al., titled "Device, Method and Program Product to Automatically Detect and Break Gas Locks in an ESP" filed on Jun. 26, 2007, the disclosures of which are incorporated herein by reference.

BACKGROUND OF THE INVENTION

1. Field of the Invention

This invention relates in general to electric submersible pumps (ESPs) and, in particular, to a method for detecting and preventing gas lock based on vibration of the ESP system.

2. Brief Description of Related Art

Electric submersible pump (ESP) assemblies are disposed within wellbores and operate immersed in wellbore fluids. The ESP assemblies generally include a pump, a seal section, and a submersible motor. Generally, the motor is downhole from the pump, and the seal section connects the motor and the pump. The motor rotates the shaft that, in turn, rotates components within the pump to lift fluid through a production tubing string to the surface. The seal section provides an area for the expansion of the ESP motor oil volume, equalizes the internal unit pressure with the wellbore annulus pressures, isolates the clean motor oil from wellbore fluids to prevent contamination, and supports the pump shaft thrust load. The pump has a pump intake proximate to the seal section that allows wellbore fluid into the pump. The pump also includes at least one impeller and at least one diffuser positioned within the pump to lift the wellbore fluid to the surface. The pump further includes a pump discharge that connects to a production tubing string to transfer wellbore fluids, pressurized in the pump, to a desired location. The pump intake may be an integral part of the pump, or the pump intake may be a separate component mechanically and rotatably connected to the pump between the pump and seal section.

In some embodiments, the ESP assembly includes a gas separator positioned between the seal section and the pump. ESPs are designed to handle liquid and will suffer from head degradation and gas locking in the presence of a high percentage of free gas. The gas separator is installed at the pump intake, between the seal section and the pump. Wellbore fluid enters the gas separator and passes through the gas separator into the pump intake. The wellbore fluid is rotated within the separator, centrifugally separating heavier wellbore fluid from lighter wellbore fluid. Generally, heavier wellbore fluid corresponds with fluid that has a lower gas content, and lighter wellbore fluid corresponds with fluid having a higher gas content. The gas separator then directs the heavier wellbore fluid to the pump section intake and the lighter wellbore fluid back into the annulus of the casing. Despite use of gas separators, gas lock may occur when an ESP ingests sufficient gas so that the ESP can no longer pump fluid to the surface due to, for example, large gas bubbles in the well fluid. This occurs despite the use of gas separators, Failure to resolve a gas-locked ESP can result in overheating and premature failure.

Conventional practice on an ESP is to set a low threshold on motor current to determine when the pump is in gas lock. When the motor pulls less current than specified to rotate the pump impellers due to gas lock, the threshold is reached. When this threshold is crossed, the pump is typically stopped and a restart is not attempted until the fluid column in the production tubing has dissipated through the pump. This wait time represents lost production. However, the current detection method may prove unreliable, potentially giving false positives. In other situations, current detection may not provide an indication of impending gas lock until after the gas lock condition manifests in the pump. Therefore, an improved system for detecting impending gas lock and adjusting pump operating conditions to prevent onset of gas lock is desired.

SUMMARY OF THE INVENTION

These and other problems are generally solved or circumvented, and technical advantages are generally achieved, by preferred embodiments of the present invention that provide a vibration method to detect onset of gas lock.

In accordance with an embodiment of the present invention, a method for detecting gas lock in an electric submersible pump assembly having an electric motor, a pump operationally coupled to the motor, and a string of discharge tubing extending from the pump to a surface is disclosed. The method provides at least one vibration sensor for detecting vibration of the electric submersible pump assembly, and operates the pump at a selected normal operation speed to pump well fluid up the well. The method monitors vibration of the electric submersible pump assembly for a predetermined period of time to create a vibration spectrum for the predetermined period of time. The method then compares the vibration spectrum to a known vibration signature associated with a pump condition, wherein the pump condition precedes gas lock. In the event the vibration spectrum is substantially similar to the known vibration signature, the method determines that the pump is operating in a pre-gas lock condition.

In accordance with another embodiment of the present invention, a submersible pump assembly is disclosed. The assembly includes a multi-stage submersible pump located in a well bore for pumping a fluid, the pump having an inlet and a discharge. The assembly also includes a motor located in the wellbore to drive the submersible pump, and a discharge line for transporting pumped fluid from the pump discharge to the surface. The assembly further includes a sensor to monitor a vibration spectrum of at least one of the pump, the motor, the gas separator, the pump intake, and the seal section, and a controller configured to receive data from the sensor and to detect an occurrence of gas lock in the multi-stage submersible pump. The controller includes a processor positioned to detect an occurrence of gas lock, an input/output interface to communicate with the sensor, and a memory having stored therein a program product, stored on a tangible computer memory media, operable on the processor, the program product comprising a set of instructions that, when executed by the processor, cause the processor to detect an occurrence of gas lock. The processor may perform the operations of: monitoring the vibration spectrum utilizing the sensor; and comparing the vibration spectrum to a known vibration signature for a pump condition that precedes gas lock over a predetermined duration to thereby detect the occurrence of gas lock in the electric submersible pump assembly.

In accordance with yet another embodiment of the present invention, a method for detecting gas lock in an electric submersible pump assembly having an electric motor, a pump operationally coupled to the motor, and a string of discharge tubing extending from the pump to a surface is disclosed. The method provides at least one vibration sensor for detecting vibration of the electric submersible pump assembly, the sensor communicatively coupled to a computer processor. The method operates the pump at a selected normal operation speed to pump well fluid up the well. The method monitors vibration of the electric submersible pump assembly with a computer processor for a predetermined period of time to create a vibration spectrum for the predetermined period of time. The method then compares the vibration spectrum to a known vibration signature associated with a pump condition with a computer processor, wherein the pump condition precedes gas lock. In the event the vibration spectrum is substantially similar to the known vibration signature, the method determines that the pump is operating in a pre-gas lock condition with a computer processor.

An advantage of the disclosed embodiments is that they provide a method for detecting gas lock that allows operators to determine gas lock onset prior to manifestation of the gas lock condition. This allows operators or operating equipment to adjust pump operation to prevent gas lock onset and/or take steps to break gas lock that may already be occurring.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

Figure 1:
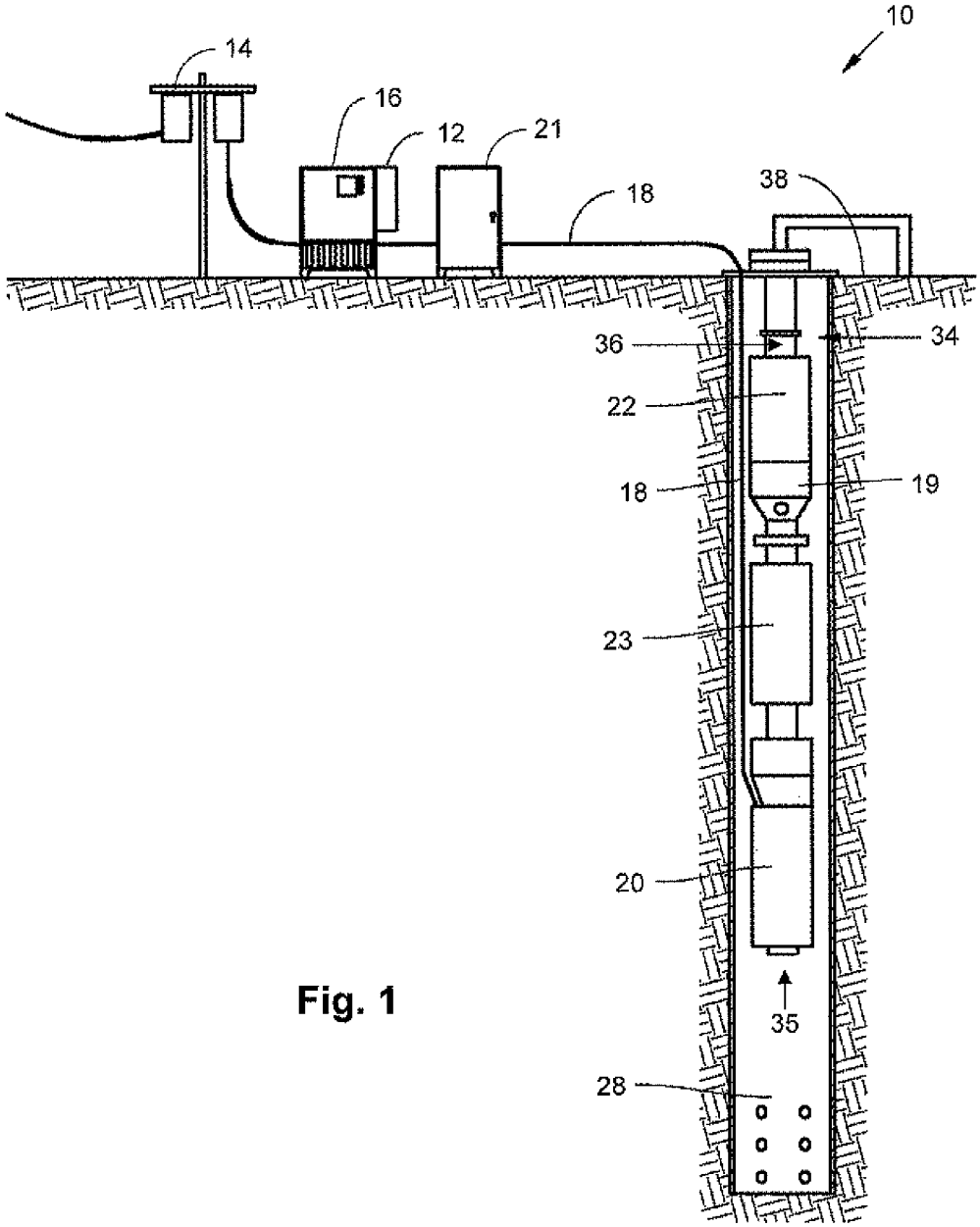
FIG. 1 is a side perspective view of an ESP assembly constructed in accordance with an embodiment of the present invention.

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning ESP operation, construction, and the like have been omitted inasmuch as such details are not considered necessary to obtain a complete understanding of the present invention, and are considered to be within the skills of persons skilled in the relevant art.

Embodiments of the present invention can detect an occurrence of gas lock in an centrifugal electric submersible pump (ESP) assembly by monitoring a pump vibration spectrum to detect a vibration signature. Persons skilled in the art will understand that the method disclosed herein may be applied to other pumping assemblies. Thus, while ESP generally refers to centrifugal electric submersible pumps, as used herein, ESP may refer to other pumps.

The pump vibration spectrum refers to a vibration component or set of vibration components for the pump. The vibration component is a specific vibration magnitude at a specific vibration frequency. For example, during operation a pump will vibrate, the pump vibration will produce a vibration spectrum for the pump consisting of a vibration component or components that relate the magnitude of the vibration to the vibration frequency during pump operation. This vibration spectrum may change during pump operation in response to changing conditions in the operating environment. The pump vibration spectrum may be compared to the vibration signature to determine an operating condition of the ESP as described in more detail below. The vibration signature may be a single vibration component, such as a vibration magnitude at a given vibration frequency, or a set of vibration components, such as a set of vibration magnitudes at given vibration frequencies. Operating conditions or states of the pump will produce different vibration signatures. These vibration signatures are naturally occurring during operation of the pump. In some conditions, the vibration signature may be associated with one or more of an impeller rotating stall condition, a diffuser stall condition, a pre-surge condition, and a condition related to the percentage of free gas in the wellbore fluid that precedes gas lock in an ESP. Monitoring of the vibration spectrum may occur through use of computer controlled equipment or controllers, as described in more detail below and compared to the known vibration signatures. When the known vibration signatures are detected in the vibration spectrum, actions may be taken to prevent or correct gas lock. Monitoring sensors can be located downhole or at the surface. Likewise, the controller can be located downhole or at the surface.

Impeller rotating stall occurs when the flow stream past the impeller separates from the back of the blade. This can occur in a variety of situations, such as when the flow angle of attack becomes too large in low flow conditions. Impeller rotating stall may also occur when a build up of gas occurs within the pump, again separating the flow through the pump from the impeller blade. When this occurs, flow through the pump is reduced and can eventually cause the pump to enter a surge condition that stops flow through the pump. When the impeller rotating stall condition occurs, the ESP may vibrate in a manner that produces a specific vibration signature. The vibration signature may be experimentally determined for a given pump design. Similar to monitoring vibration signatures of the pump, vibration signatures of the pump intake, gas separator, production tubing string, and the like may be determined and associated with pre-gas lock conditions.

Still further, vibration signatures for varying percentages of free gas within a gas separator may be determined through experimental testing of a particular gas separator in a fluid having a known quantity of free gas. During testing, vibration sensors located on the gas separator may record vibration spectrums for the gas separator in the known gas content fluid to produce a vibration signature for the known gas content. This information may then be used in a producing well to monitor vibration spectra of the gas separator in an operating environment to determine, an estimated quantity of free gas in the produced fluid, as described in more detail below.

With reference now to FIG. 1, one type of ESP assembly in a well production system 10 is located within a well bore 28. Well production system 10 includes a pump 22, a motor 20, and a seal assembly 23 located between pump 22 and motor 20. A person skilled in the art will understand that pump 22 may be a centrifugal pump. System 10 further includes a variable speed drive 16 and a data monitoring and control device 12, e.g., a controller, typically located on a surface 38 and associated with variable speed drive 16. Variable speed drive 16 is powered by a power source 14. System 10 includes a power cable 18 that provides power and, optionally, communications between variable speed drive 16 and motor 20. A step-up transformer 21 may be located between variable speed drive 16 and motor 20. Variable speed drive 16 may operate as a power source for providing electrical power for driving motor 20. Controller 12 associated with variable speed drive 16 controls the voltage at motor 20 terminals by altering the output voltage and frequency of variable speed drive 16. Typically, cable 18 connects to a motor lead extension (not shown) proximate to the pumping system. The motor lead extension continues in well bore 28 adjacent the pump assembly and terminates in what is commonly referred to as a "pothead connection" at motor 20. In one embodiment, the motor terminal comprises the pothead connection.

Well production system 10 also includes downhole artificial lift equipment for aiding production, which comprises induction motor 20 and electric submersible pump 22 ("ESP"), which may be of the type disclosed in U.S. Pat. No. 5,845,709. Motor 20 is mechanically coupled to and drives pump 22. Pump 22 induces the flow of gases and liquid up the borehole to the surface for further processing. This is accomplished by rotation of a shaft that couples motor 20 to staged impellers within staged diffusers positioned in pump 22. As motor 20 rotates the shaft, the impellers will rotate to lift the fluid up the borehole. Three-phase cable 18, motor 20, variable speed drive 16, seal assembly 23 and pump 22 form an ESP system. A person skilled in the art will understand that the ESP system may also include a gas separator 19 interposed between seal assembly 23 and pump 22. Gas separator 19 may include a pump intake. Pump 22 can be, for example, a multi-stage centrifugal pump having a plurality of rotating impeller stages and diffuser stages which increase the pressure level of the well fluids for pumping the fluids to the surface location. The upper end of pump 22 is connected to the lower end of a discharge line 34 for transporting well fluids to a desired location.

Figure 2:
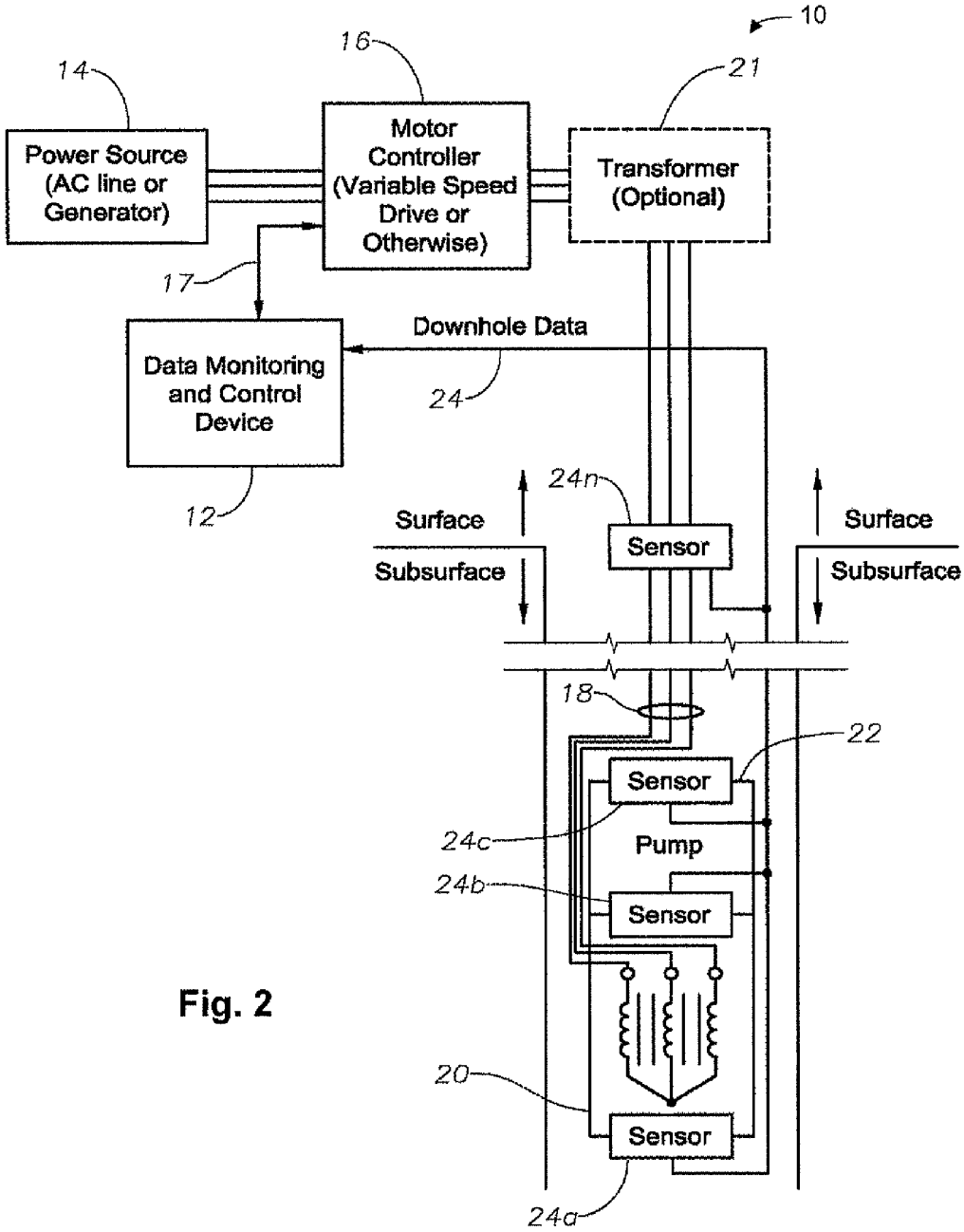
FIG. 2 is a schematic diagram of an ESP assembly constructed in accordance with an embodiment of the present invention.

FIG. 2 illustrates an exemplary embodiment of the power and control of well production system 10, including data monitoring and control device 12, e.g., a controller. System 10 includes power source 14 comprising an alternating current power source such as an electrical power line (electrically coupled to a power utility plant) or a generator electrically coupled to and providing three-phase power to variable speed drive 16. Variable speed drive 16 can be any of the well known varieties, such as pulse width modulated variable frequency drives or other known controllers which are capable of varying the speed of production system 10. Both power source 14 and variable speed drive 16 are located at the surface level of the borehole and are electrically coupled to motor 20 via three-phase power cable 18. Transformer 21 can be electrically coupled between variable speed drive 16 and induction motor 20 in order to step the voltage up or down as required.

Data monitoring and control device 12, typically a surface unit, may communicate with downhole sensors **24*a*-24*n* via, for example, bi-directional link 24 or alternately via cable 18. In an exemplary embodiment, sensors 24*a*-24*n* monitor and measure various conditions within the borehole, such as pump discharge pressure, pump intake pressure, tubing surface pressure, vibration, ambient well bore fluid temperature, motor voltage and/or current, motor oil temperature and the like. Although not shown, data monitoring and control device 12 may also include a data acquisition, logging (recording) and control system which would allow device 12 to control the downhole system based upon the downhole measurements received from sensors 24*a*-24*n* via, for example, bi-directional link 24. Sensors 24*a*-24*n* can be located in any suitable location of well production system 10. For example, sensors 24*a*-24*n* may be located downhole within or proximate to induction motor 20, ESP 22, a pump intake of ESP 22, gas separator 19, discharge line 34, or any other location within the borehole. Any number of sensors may be utilized as desired. In the disclosed embodiments, sensors 24*a*-24*n* comprise a plurality of accelerometers adapted to sense vibration magnitude and frequency. Sensors 24*a*-24*n* may be positioned to detect at least one of vibration frequency, and vibration amplitude of the pump 22**.

Further referring to FIG. 2, data monitoring and control device 12 is linked to sensors **24*a*-24*n* via communication link 24 and variable speed drive 16 via link 17 in order to detect and break gas locks without requiring system shutdown. In an example embodiment, the gas lock detecting and breaking functionality of device 12 is conducted based solely upon vibration frequency measurements from sensors 24*a*-24*n* attuned to the vibration of impellers within pump 22**.

Data monitoring and control device 12 communicates over well production system 10, using the communication links described herein, on at least a periodic basis utilizing techniques, such as, for example, those disclosed in U.S. Pat. No. 6,587,037, entitled METHOD FOR MULTI-PHASE DATA COMMUNICATIONS AND CONTROL OVER AN ESP POWER CABLE and U.S. Pat. No. 6,798,338, entitled RF COMMUNICATION WITH DOWNHOLE EQUIPMENT. Device 12 is coupled to variable speed drive 16 via bi-directional link 17 in order to receive measurements such as, for example, amperage, current, voltage and/or frequency regarding the three phase power being transmitted downhole. Such control signals would regulate the operation of motor 20 and/or pump 22 to optimize production of well production assembly 10, such as, detecting and breaking gas locks. Moreover, these control signals may be transmitted to some other desired destination for further analysis and/or processing.

Data monitoring and control device 12 controls variable speed drive 16 by controlling such parameters as on/off, frequency (F), and/or voltages, each at one of a plurality of specific frequencies, which effectively varies the operating speed of motor 20. Such control is conducted via link 17. The functions of device 12 may execute within the same hardware as the other components comprising device 12, or each component may operate in a separate hardware element. For example, the data processing, data acquisition/logging and data control functions of the present invention can be achieved via separate components or all combined within the same component.

During production, some wells produce gas along with oil. As such, there is a tendency for the gas to enter the pump assembly 22 along with the well fluid, which can decrease the volume of oil produced or may even lead to a "gas lock." A gas lock is a condition in an ESP assembly in which gas interferes with the proper operation of impellers and other pump components, preventing the pumping of liquid.

Figure 3:
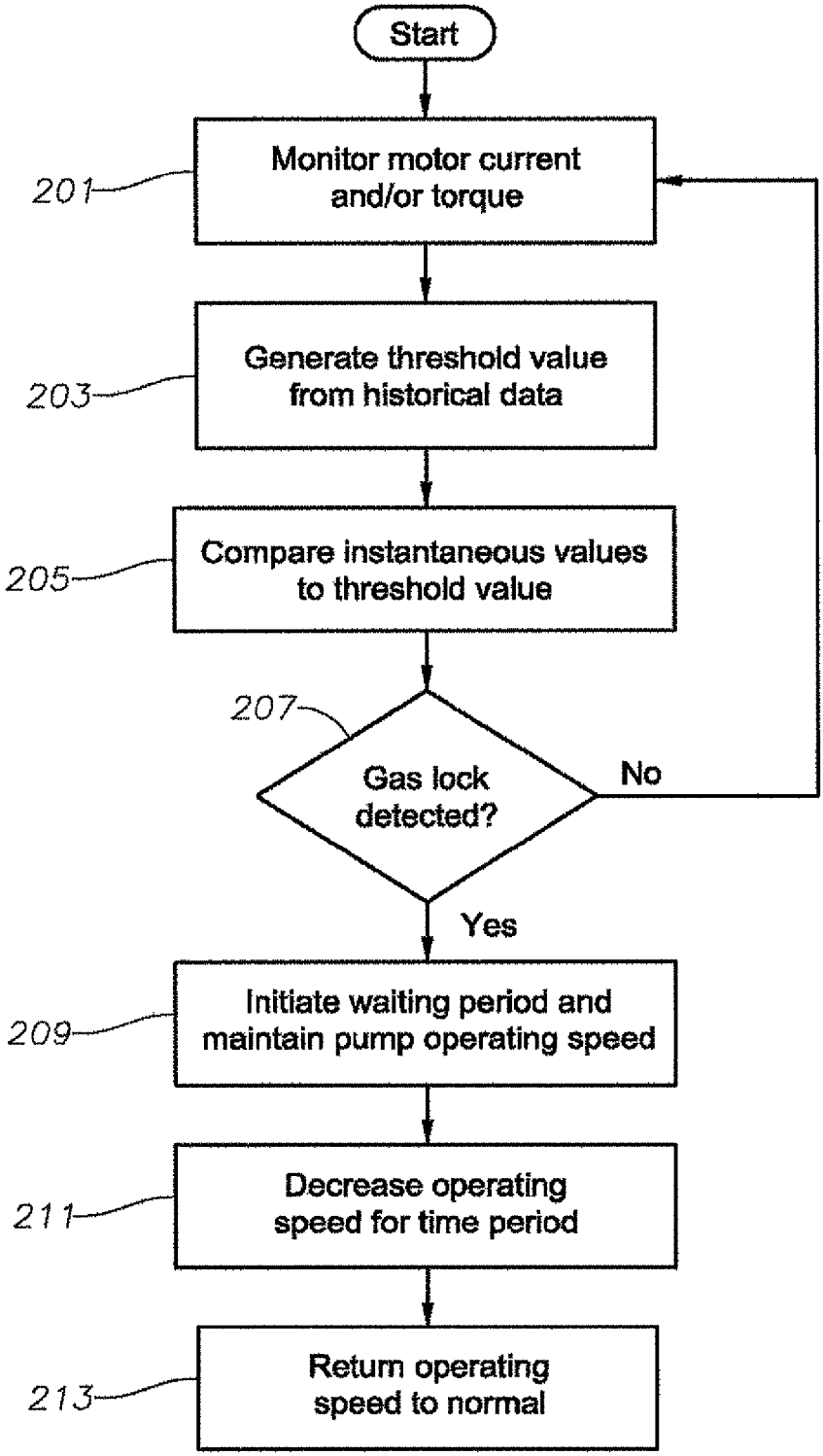
FIG. 3 is a flow diagram of a method of detecting and breaking gas lock according to an embodiment of the present invention.

Referring to FIG. 3, an exemplary algorithm for detecting and breaking a gas lock will now be described. Data monitoring and control device 12 also comprises a processor and memory which performs the logic, computational, and decision-making functions of the present invention and can take any form as understood by those in the art. See, e.g., FIGS. 6 and 7. The memory can include volatile and nonvolatile memory known to those skilled in the art including, for example, RAM, ROM, and magnetic or optical disks, just to name a few.

At step 201, data monitoring and control device 12, e.g., the controller, continuously monitors the output current, voltage and/or torque of motor controller 16 via bi-directional link 17 in order to detect and break gas locks in accordance with the present invention. However, in the alternative, output measurements from downhole sensors 24*a*-24*n* may also be monitored. At step 203, data monitoring and control device 12 will generate a threshold value of the motor current and/or torque from historical data. The threshold value can be based on a historical value, such as a long-term average of the motor current or motor torque using a time constant long enough to filter out any short term variations in such measurements. Alternately, the threshold value can be based on another historical value, such as a peak value for given data window. When a gas lock does occur, the motor current or motor torque will typically decrease by 30-50%. To determine a 30% drop in the motor torque and/or current, the threshold value can be generated to be, for example, 70% of a long-term average value. Alternately, the threshold value can be generated to be 65% to 75% of a peak value for a given historical data window, i.e., a predetermined period of between 2 and 5 minutes, preferably the last 3 minutes. Thereafter, at step 205, the instantaneous value is continuously compared to the threshold value. In another preferred embodiment, the motor torque is measured instead of the motor current because the torque is more sensitive to downhole phenomena. If control device 12 does not detect an occurrence of gas lock based on the comparison in step 207, the algorithm loops back to step 201 and begins the process again.

Should data monitoring and control device 12 detect an occurrence of gas lock, control device 12 will proceed to step 209. At this step, control device 12 will instruct motor controller 16 via link 17 to maintain the same operating speed for a predetermined waiting period. In the most preferred embodiment, this waiting period has a length of 6 to 7 minutes, however, other waiting periods, including a waiting period of 3 to 15 minutes, can be programmed based upon design constraints. In an alternative embodiment, the waiting period will be limited, at least in part, by a predetermined maximum pump temperature, which would be communicated to device 12 from downhole sensors 24*a*-24*n* via communication link 24.

Further referring to the exemplary algorithm of FIG. 3, as motor 20 maintains this operating speed at step 209, it produces a somewhat static condition as pump 22 produces just enough head to support the column of fluid in the tubing above, but not enough to pump the fluid upwards to the surface. As a result, the gas bubbles in the fluid directly over the pump begin to rise, while the fluid settles and becomes denser.

At step 211, data monitoring and control device 12 ends the waiting period and decreases the operating frequency to a lower value, such as, for example, 20-25 Hz. The normal operating frequency is typically set at 60 Hz. This decreased operating frequency is maintained for a predetermined period of time, such as, for example, 10-15 seconds. During this time, pump 22 can no longer support the fluid column just above it and, thus, the fluid begins to fall back through pump 22, flushing out the trapped gas. At the end of this low speed period of step 211, device 12 increases the operating frequency of pump 22 back to normal and production begins again at step 213.

Embodiments of the present invention further provide an algorithm for optimizing an operating speed of the electrical submersible pump assembly to maximize production without need for operator intervention. The algorithm increases the pump operating speed by a predetermined increment, e.g., between 0.08 and 0.4 Hz, preferably 0.1 Hz, up to a preset maximum pump operating speed, e.g., 62 Hz, when the instantaneous value is continually above the threshold value for a predetermined stabilization period, e.g., between 10 to 20 minutes, preferably 15 minutes. The algorithm decreases the pump operating speed by a predetermined increment, e.g., between 0.08 and 0.4 Hz, preferably 0.1 Hz, if the instantaneous value is continually below the threshold value for a predetermined initialization period, e.g., between 90 seconds and 3 minutes, preferably 2 minutes. In the absence of gas lock or gas bubbles for a reasonable period of time, the algorithm increases the pump operating speed in a step-wise fashion to maximize production. In the presence of gas bubbles but not true gas lock, the algorithm does not alter the pump operating speed. Gas bubbles, without causing an occurrence of gas lock, can cause a temporary drop in the motor current or motor torque as understood by those skilled in the art. If the algorithm detects an occurrence of gas lock, in which the instantaneous value is continually below the threshold value for a period of time, e.g., 2 minutes, the algorithm lowers the pump operating speed (and the rate of production) by a small increment to better adjust to the level of gas and attempt to prevent further occurrences of gas lock as understood by those skilled in the art.

Figure 4:
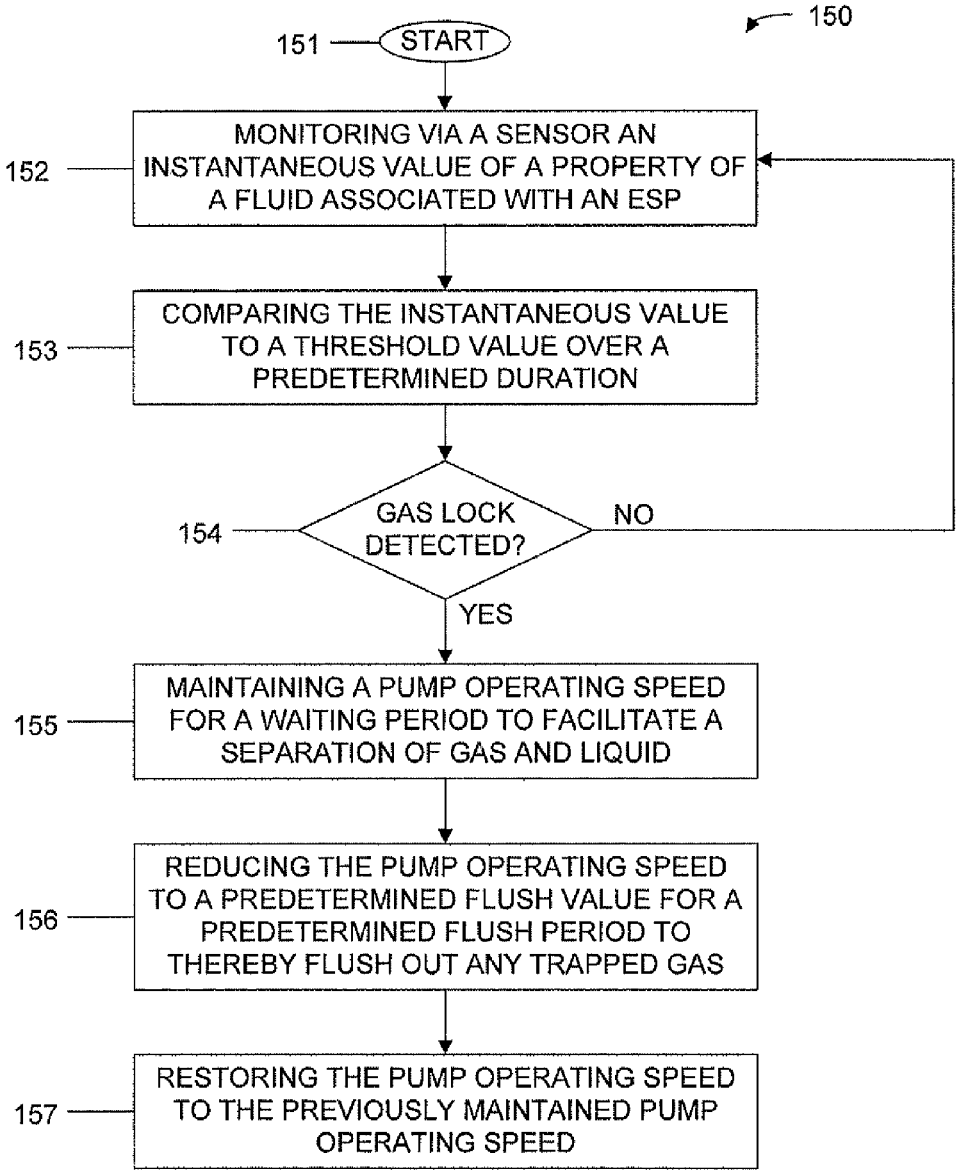
FIG. 4 is a flow diagram of a method of detecting and breaking gas lock according to an embodiment of the present invention.

As illustrated in FIG. 4, embodiments of the present invention can include a method 150 of detecting a gas lock in an electrical submersible pump assembly. The method 150 can include monitoring via a sensor 24*a*-24*n* an instantaneous value of a property of a fluid associated with an electrical submersible pump assembly (step 152). The assembly can include a multi-stage electrical submersible pump 22 having an inlet 35 and a discharge 36, a pump motor 20 to drive the pump 22, a discharge line 34 for transporting pumped fluid from the pump discharge to the surface 38, and a controller 12 configured to receive data from the sensor 24*a*-24*n* and to detect an occurrence of gas lock in the electrical submersible pump assembly. The method 150 can also include comparing the instantaneous value to a threshold value over a predetermined duration by the controller 12 to thereby detect the occurrence of gas lock in the electrical submersible pump assembly (step 153). If gas lock is detected by the controller (step 154), the method can further include breaking the detected occurrence of gas lock by: maintaining a pump operating speed for a first predetermined duration defining a waiting period to facilitate a separation of gas and liquid located above the pump (step 155), reducing the pump operating speed to a predetermined value defining a flush value for a second predetermined duration defining a flush period so that the fluid located above the pump falls back through the pump flushing out any trapped gas (step 156), and restoring the pump operating speed to the previously maintained pump operating speed (step 157). In a preferred embodiment, the waiting period is between 6 to 7 minutes, the flush period is between 10 and 15 seconds, and the pump operating speed is reduced during the flush period to between 20 and 25 Hz.

In an example embodiment, the sensor 24*a*-24*n* can be a differential pressure gauge for measuring a differential pressure of the fluid in the pump between the pump inlet 35 and pump discharge 36, e.g., the bottom and top of the pump, to determine a drop in pressure. For example, a decrease of about 50% of a normal pressure, e.g., an average pressure, for a period of about 30 seconds can indicate gas lock.

In another example embodiment, the sensor 24*a*-24*n* can be a pressure gage located in a pump stage located toward the inlet 35, e.g., the bottom stages of the pump, to determine a drop in pressure. For example, a decrease of about 30% of a historical pressure, e.g., a peak pressure of the past three (3) minutes, for a period of about 30 seconds can indicate gas lock.

In yet another example embodiment, the sensor 24*a*-24*n* can be a fluid temperature sensor located toward the discharge 36, e.g., the top of the pump, to determine an increase in temperature. For example, an increase of about 20% of a historical temperature, e.g., a rolling average of the values over the past five (5) minutes, for a period of about 30 seconds can indicate gas lock.

In another example embodiment, the sensor 24*a*-24*n* can be a free gas detector located within the pump to determine a high level of free gas of a function of volume. For example, a level of free gas above about 50% by volume for a period of about 30 seconds can indicate gas lock.

In another example embodiment, the sensor 24*a*-24*n* can be an electrical resistivity gage located within the pump to determine a high level of resistivity. For example, a high level of resistivity of about 200 Ohms per cm or more for a period of about 30 seconds can indicate gas lock.

In another example embodiment, the sensor 24*a*-24*n* can be a flow meter located within surface production tubing to determine no or little flow. For example, a flow of about zero for a period of about 30 seconds can indicate gas lock.

In another example embodiment, the sensor 24*a*-24*n* can be a vibration sensor attached to a tubing string to measure an acceleration of the fluid within the tubing string to determine a vibration signature, or characteristic pattern of vibration, responsive to the measured acceleration of the fluid. The vibration signature can refer to the actual signal from a vibration sensor and also the spectrum, or frequency-based representation. The determined vibration signature can then be compared to one or more predetermined vibration signatures stored in memory and associated with gas lock to thereby indicate gas lock. The predetermined vibration signatures can be determined by testing as understood by those skilled in the art. As understood by those skilled in the art, a vibration sensor can include an XY vibration sensor, which is a sensor that measures vibration or acceleration in two dimensions, or along two axes. As described in jointly-owned pending U.S. patent application Ser. No. 12/360,677, titled "Electrical Submersible Pump Rotation Sensing Using an XY Vibration Sensor," filed on Jan. 27, 2009, which is incorporated herein in its entirety, the measurements for the two dimensions can be correlated through a Fourier analysis, or other frequency analysis as understood by those skilled in the art, to determine a frequency and direction of rotation of an ESP.

Figure 5:
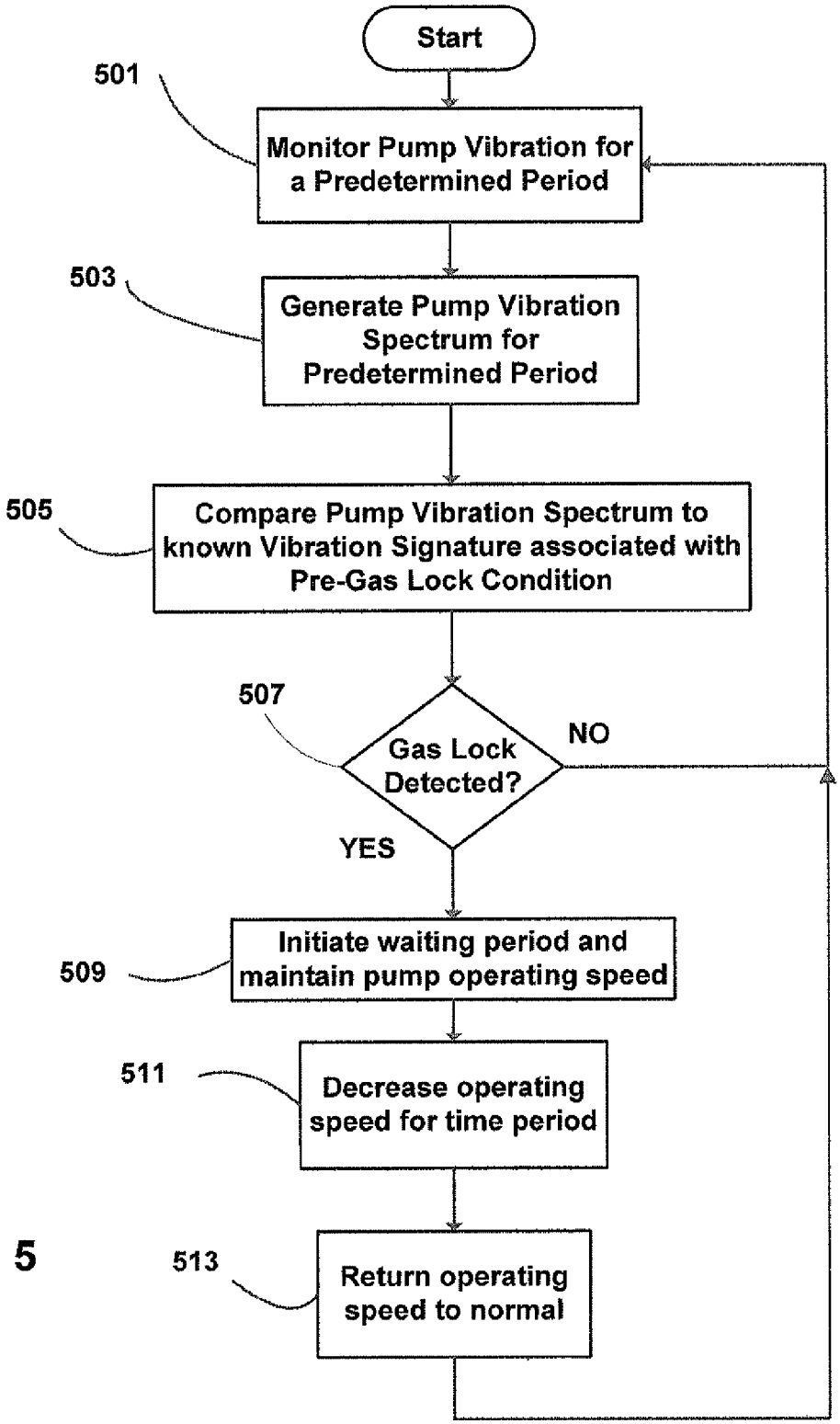
FIG. 5 is a flow diagram of a method of detecting and breaking gas lock according to an embodiment of the present invention.

Referring to FIG. 5, an exemplary algorithm for detecting and breaking a gas lock using vibration monitoring will now be described. Data monitoring and control device 12 also comprises a processor and memory which performs the logic, computational, and decision-making functions of the present invention and can take any form as understood by those in the art. See, e.g., FIGS. 6 and 8. The memory can include volatile and nonvolatile memory known to those skilled in the art including, for example, RAM, ROM, and magnetic or optical disks, just to name a few.

At step 501, data monitoring and control device 12, e.g., the controller, continuously monitors the vibration of pump 22 via sensors 24*a*-24*n* through bi-directional link 24 for a predetermined period to detect impending gas locks in accordance with the present invention. At step 503, data monitoring and control device 12 will generate a pump vibration spectrum for the predetermined period. Thereafter, at step 505, the pump vibration spectrum is compared to the known vibration signature associated with a pre-gas lock condition, such as an impeller rotating stall condition, a diffuser stall condition, a pre-surge condition, a percentage of free gas in the wellbore fluid, or the like to determine if the pump is operating in the pre-gas lock condition. In other embodiments, production/discharge tubing, pump intake, gas separator, or motor vibration spectra are monitored and compared. If control device 12 determines that the pump is not operating in the pre-gas lock condition based on the comparison in step 507, the algorithm loops back to step 501 and begins the process again.

Monitoring and detection may occur on a continuous basis. For example, each data point collected during monitoring and detection may be stored for a period of one minute. As each data point reaches the one minute lifespan, it is replaced by a new data point. The vibration spectrum is then compared against the known vibration signature for the one minute period as each new data point is produced. A person skilled in the art will understand that the example is provided for illustrative purposes only and is not intended to be a limitation of the method disclosed herein.

Should data monitoring and control device 12 determine the pump is operating in the pre-gas lock condition, control device 12 may proceed to step 509. At this step, control device 12 will instruct variable speed drive 16 via link 17 to maintain operating speed for a predetermined waiting period. In the disclosed embodiment, this waiting period has a length of 6 to 7 minutes, however, other waiting periods, including a waiting period of 3 to 15 minutes, can be programmed based upon design constraints. In an alternative embodiment, the waiting period will be limited, at least in part, by a predetermined maximum pump temperature, which would be communicated to device 12 from downhole sensors 24*a*-24*n* via communication link 24.

Further referring to the exemplary algorithm of FIG. 3, as motor 20 maintains this operating speed at step 509, it produces a somewhat static condition as pump 22 produces just enough head to support the column of fluid in the tubing above, but not enough to pump the fluid upwards to the surface. As a result, the gas bubbles in the fluid directly over the pump begin to rise, while the fluid settles and becomes denser.

At step 511, data monitoring and control device 12 ends the waiting period and decreases the operating frequency to a lower value, such as, for example, 20-25 Hz. The normal operating frequency is typically set at 60 Hz. This decreased operating frequency is maintained for a predetermined period of time, such as, for example, 10-15 seconds. During this time, pump 22 can no longer support the fluid column just above it and, the fluid begins to fall back through pump 22, flushing out the trapped gas. At the end of this low speed period of step 511, device 12 increases the operating frequency of pump 22 back to normal, and production begins again at step 513. Monitoring of impeller vibration continues at step 501.

As described above, the sensor 24*a*-24*n* may monitor vibration of the pump 22, the pump discharge 36, the gas separator 19, a pump intake, the seal section 23, the motor 20, or any other component of the well production system 10 and the ESP assembly. In addition, vibration of additional components or structural components coupled to the well production system 10 may be monitored. Similar to use of the sensor 24*a*-24*n* to monitor the production tubing or the production line 34, and the pump 22, the sensor 24*a*-24*n* will determine a vibration signature, or characteristic pattern of vibration, responsive to the measured acceleration of the monitored component. The vibration signature can refer to the actual signal from a vibration sensor and also the spectrum, or frequency-based representation. The determined vibration signature can then be compared to one or more predetermined vibration signatures stored in memory and associated with gas lock to, thereby indicate gas lock. The predetermined vibration signatures can be determined by testing as described above. For example, monitoring of the pump 22 may detect an impeller rotating stall condition or a pre-surge condition as described above.

Embodiments of a data monitoring and control device 12, e.g., a controller, may take various forms. In one embodiment, control device 12 may be part of the hardware located at the well site, included in the software of a programmable ESP controller or variable speed drive, or control device 12 may be a separate box with its own CPU and memory coupled to such components. Also, control device 12 may even be located across a network and include software code running in a server which bi-directionally communicates with production system 10 to receive surface and/or downhole readings and transmit control signals accordingly.

Figure 6:
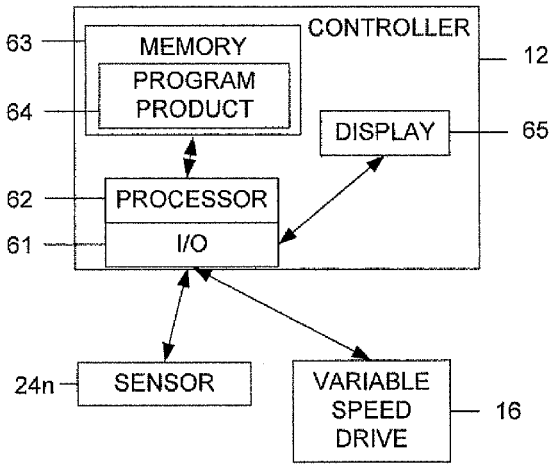
FIG. 6 is a schematic diagram of a controller for detecting and breaking gas lock according to an embodiment of the present invention.

As illustrated in FIG. 6, example embodiments include controller 12, having, for example, input-output I/O devices, e.g., an input/output interface 61; one or more processors 62; memory 63, such as, tangible computer readable media; and optionally a display 65. The memory 63 of the controller can include program product 64 as described herein.

Figure 7:
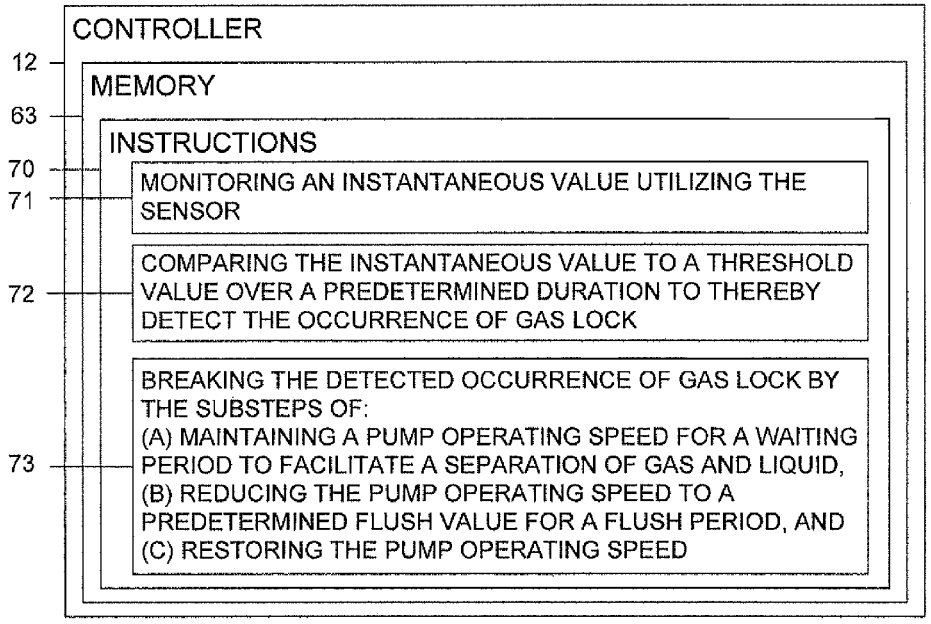
FIG. 7 is a schematic diagram of a controller having computer program product stored in memory thereof according to an embodiment of the present invention.

As illustrated in FIGS. 6 and 7, embodiments of the present invention include a memory 63 having stored therein a program product, stored on a tangible computer memory media, operable on the processor 62, the program product comprising a set of instructions 70 that, when executed by the processor 62, cause the processor 62 to detect an occurrence of gas lock by performing various operations. The operations include: monitoring an instantaneous value utilizing the sensor 71 and comparing the instantaneous value to a threshold value over a predetermined duration to thereby detect the occurrence of gas lock in the electrical submersible pump assembly 72. The operations further include breaking the detected occurrence of gas lock by the substeps of (a) maintaining a pump operating speed for a first predetermined period defining a waiting period to facilitate a separation of gas and liquid located above the pump, (b) reducing the pump operating speed to a predetermined value defining a flush value for a second predetermined period defining a flush period so that the fluid located above the pump falls back through the pump flushing out any trapped gas, and (c) restoring the pump operating speed to the previously maintained pump operating speed 73.

Example embodiments also include computer program product stored on a tangible computer readable medium that is readable by a computer, the computer program product comprising a set of instructions that, when executed by a computer, causes the computer to perform the various operations. The operations can include detecting an occurrence of gas lock in a electrical submersible pump assembly, including (i) monitoring an instantaneous value associated with the pump motor of the electrical submersible pump assembly, (ii) generating a threshold value based on historical data of values associated with the pump motor of the electrical submersible pump assembly, and (iii) comparing the instantaneous value to the threshold value to thereby detect the occurrence of gas lock in the electrical submersible pump assembly. The operations can further include breaking the detected occurrence of gas lock, including (i) maintaining a pump operating speed for a first predetermined duration defining a waiting period to facilitate a separation of gas and liquid located above the pump, (ii) reducing the pump operating speed to a predetermined value defining a flush value for a second predetermined duration defining a flush period so that the fluid located above the pump falls back through the pump flushing out any trapped gas, and (iii) restoring the pump operating speed to the previously maintained pump operating speed.

Figure 8:
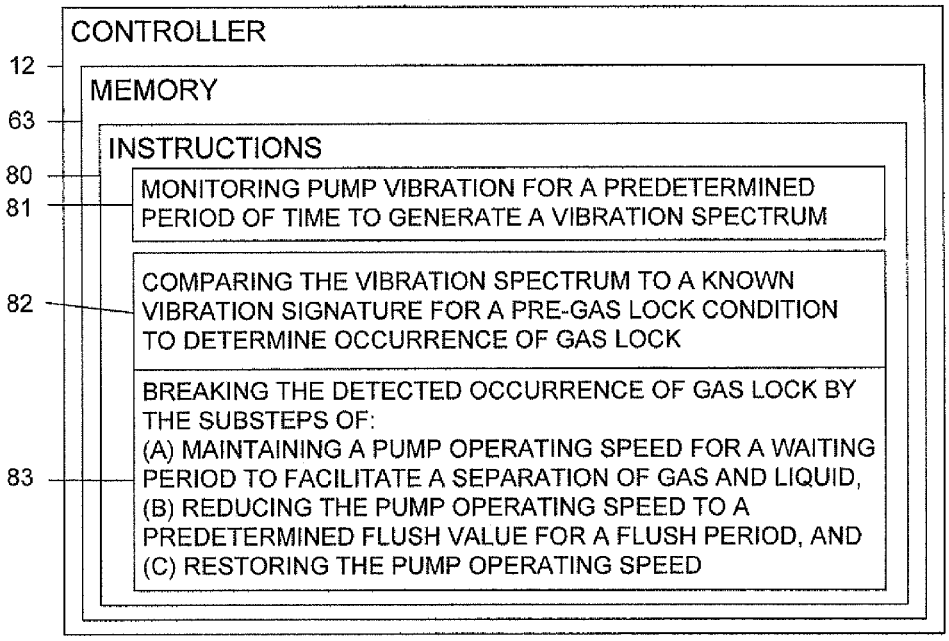
FIG. 8 is a schematic diagram of a controller having computer program product stored in memory thereof according to an embodiment of the present invention.

As illustrated in FIGS. 6 and 8, embodiments of the present invention include a memory 63 having stored therein a program product, stored on a tangible computer memory media, operable on the processor 62, the program product comprising a set of instructions 80 that, when executed by the processor 62, cause the processor 62 to detect an occurrence of gas lock by performing various operations. The operations include: at 81, monitoring an ESP vibration spectrum utilizing the sensor and, at 82, comparing the ESP vibration spectrum set to the known vibration signature for the pre-gas lock condition over a predetermined duration to thereby detect the precursor of gas lock in the electric submersible pump assembly. The operations further include, at 83, breaking the detected occurrence of gas lock by the substeps of: (a) maintaining a pump operating speed for a first predetermined period defining a waiting period to facilitate a separation of gas and liquid located above the pump, (b) reducing the pump operating speed to a predetermined value defining a flush value for a second predetermined period defining a flush period so that the fluid located above the pump falls back through the pump flushing out any trapped gas, and (c) restoring the pump operating speed to the previously maintained pump operating speed.

Example embodiments also include computer program product stored on a tangible computer readable medium that is readable by a computer, the computer program product comprising a set of instructions that, when executed by a computer, causes the computer to perform the various operations described above. The operations can include detecting an occurrence of gas lock in a electric submersible pump assembly, including (i) monitoring a pump vibration spectrum, (ii) generating a pump vibration spectrum for a predetermined period of time, and (iii) comparing the pump vibration spectrum to the known pump vibration signature for pre-gas lock conditions to thereby detect the precursor of gas lock in the electric submersible pump assembly. The operations can further include breaking the detected occurrence of gas lock, including (i) maintaining a pump operating speed for a first predetermined duration that defines a waiting period to facilitate a separation of gas and liquid located above the pump, (ii) reducing the pump operating speed to a predetermined value that defines a flush value for a second predetermined duration that defines a flush period so that the fluid located above the pump falls back through the pump flushing out any trapped gas, and (iii) restoring the pump operating speed to the previously maintained pump operating speed.

It is important to note that while embodiments of the present invention have been described in the context of a fully functional system and method embodying the invention, those skilled in the art will appreciate that the mechanism of the present invention and/or aspects thereof are capable of being distributed in the form of a computer readable medium of instructions in a variety of forms for execution on a processor, processors, or the like, and that the present invention applies equally regardless of the particular type of signal bearing media used to actually carry out the distribution. Examples of computer readable media include but are not limited to: nonvolatile, hard-coded type media such as read only memories (ROMs), CD-ROMs, and DVD-ROMs, or erasable, electrically programmable read only memories (EEPROMs), recordable type media such as floppy disks, hard disk drives, CD-R/RWs, DVD-RAMs, DVD-R/RWs, DVD+R/RWs, flash drives, and other newer types of memories, and transmission type media such as digital and analog communication links. For example, such media can include both operating instructions and/or instructions related to the system and the method steps described above.

Example embodiments can include different durations for determining gas lock. As understood by those skilled in the art, too short of a duration can result in false positives; similarly, too long of a duration can result in delayed detection, perhaps resulting in damage to the ESP. Example embodiments can include a predetermined duration for the comparison. For example the predetermined duration may be a period between about 15 seconds and about 1 minute or more.

Embodiments of the present invention have significant advantages. Example embodiments have the ability to reliably detect a gas lock, without operator intervention, based upon surface data and/or downhole data. Also, example embodiments have the ability to break a gas lock once detected, without requiring system to be shut down. The disclosed embodiments also provide a method to detect the potential occurrence of the gas lock condition prior to actual gas lock in centrifugal ESPs by monitoring vibration of the pump and pump assembly components. In addition, the disclosed methods may allow a determination of the percentage of free gas flowing through the pump assembly. This allows an operator or operating equipment to adjust operation of the pump to prevent gas lock from occurring.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A method for detecting gas lock in an electric submersible pump assembly having an electric motor, a pump operationally coupled to the motor, and a string of discharge tubing extending from the pump to a surface, the method comprising:

(a) providing at least one vibration sensor for detecting vibration of the electric submersible pump assembly;

(b) operating the pump at a selected normal operation speed to pump well fluid up the well;

(c) monitoring vibration of the electric submersible pump assembly for a predetermined period of time to create a vibration spectrum for the predetermined period of time;

(d) comparing the vibration spectrum to a known vibration signature associated with a pump condition, wherein the pump condition precedes gas lock; and (e) in the event the vibration spectrum is substantially similar to the known vibration signature, determining that the pump is operating in a pre-gas lock condition.

2. The method of claim 1, wherein step (c) comprises monitoring vibration of the pump.

3. The method of claim 2, wherein the pump is a centrifugal pump.

4. The method of claim 2, wherein the pump condition is impeller rotating stall.

5. The method of claim 2, wherein the pump condition is diffuser stall.

6. The method of claim 2, wherein the pump condition is a pre-surge condition.

7. The method of claim 1, wherein step (c) comprises monitoring vibration of a gas separator of the pump assembly.

8. The method of claim 7, wherein the pump condition is a percentage of free gas in the gas separator.

9. The method of claim 1, wherein step (c) comprises monitoring vibration of a pump intake of the pump assembly.

10. The method of claim 1, wherein in the event the pump is operating in a pre-gas lock condition, the method further comprises adjusting a pump control parameter to prevent gas lock.

11. The method of claim 10, wherein adjusting the pump control parameter comprises operating the pump at a selected high rate of speed for a selected duration to maintain at least a static head of well fluid above the pump, then lowering the rate of speed to a selected low rate of speed for a selected duration to allow the head of well fluid to flow down through the pump and flush gas from the pump, then resuming the selected normal operation speed.

12. A submersible pump assembly comprising:

a multi-stage submersible pump located in a well bore for pumping a fluid, the pump having an inlet and a discharge;

a motor located in the wellbore to drive the submersible pump;

a discharge line for transporting pumped fluid from the pump discharge to the surface;

a sensor to monitor a vibration spectrum of at least one of a pump of the submersible pump assembly, a motor of the submersible pump assembly, a gas separator of the submersible pump assembly, a pump intake of the submersible pump assembly, and a seal section of the submersible pump assembly;

a controller configured to receive data from the sensor and to detect an occurrence of gas lock in the multi-stage submersible pump, the controller comprising:

a processor positioned to detect an occurrence of gas lock, an input/output interface to communicate with the sensor, and a memory having stored therein a program product, stored on a tangible computer memory media, operable on the processor, the program product comprising a set of instructions that, when executed by the processor, cause the processor to detect an occurrence of gas lock by performing the operations of:

monitoring the vibration spectrum utilizing the sensor; and comparing the vibration spectrum to a known vibration signature for a pump condition that precedes gas lock over a predetermined duration to thereby detect the occurrence of gas lock in the electric submersible pump assembly.

13. The submersible pump assembly of claim 12, wherein the multi-stage submersible pump is a centrifugal pump.

14. The submersible pump assembly of claim 12, wherein the sensor is positioned on at least one of an intake of the pump and a gas separator of the pump.

15. The submersible pump assembly of claim 12, wherein the pump condition is at least one of impeller rotating stall, diffuser stall, a pre-surge condition, and a percentage of free gas in the fluid.

16. A method for detecting gas lock in an electric submersible pump assembly having an electric motor, a pump operationally coupled to the motor, and a string of discharge tubing extending from the pump to a surface, the method comprising:

(a) providing at least one vibration sensor for detecting vibration of the electric submersible pump assembly, the sensor communicatively coupled to a computer processor;

(b) operating the pump at a selected normal operation speed to pump well fluid up the well;

(c) monitoring vibration of the electric submersible pump assembly with a computer processor for a predetermined period of time to create a vibration spectrum for the predetermined period of time;

(d) comparing the vibration spectrum to a known vibration signature associated with a pump condition with a computer processor, wherein the pump condition precedes gas lock; and (e) in the event the vibration spectrum is substantially similar to the known vibration signature, determining that the pump is operating in a pre-gas lock condition with a computer processor.

17. The method of claim 16, wherein the pump condition comprises at least one of an impeller rotating stall condition, a diffuser stall condition, a pre-surge condition, and a percentage of free gas in the well fluid.

18. The method of claim 16, wherein step (c) further comprises monitoring at least one of pump vibration, gas separator vibration, pump intake vibration, seal vibration, and motor vibration.

19. The method of claim 16, wherein in the event the pump is operating in a pre-gas lock condition, the method further comprises adjusting a pump control parameter to prevent gas lock.

20. The method of claim 19, wherein adjusting the pump operational speed, with a computer processor, comprises operating the pump at a selected high rate of speed for a selected duration to maintain at least a static head of well fluid above the pump, then lowering the rate of speed to a selected low rate of speed for a selected duration to allow the head of well fluid to flow down through the pump and flush gas from the pump, then resuming the selected normal operation speed.

* * * * *